US006024192A

United States Patent [19]

Griffin

[11] Patent Number: 6,024,192

[45] Date of Patent: Feb. 15, 2000

[54] LADDER VISE

[76] Inventor: Maurice B. Griffin, 8715 Patricia Ct., Pomfret, Md. 20675

[21] Appl. No.: 09/160,177

[22] Filed: Sep. 25, 1998

Related U.S. Application Data

[60] Provisional application No. 60/082,296, Apr. 20, 1998.

[51] Int. Cl.[7] ..... E06C 7/14

[52] U.S. Cl. ..... 182/129; 248/210; 248/229.5

[58] Field of Search ..... 182/129, 206; 248/229.5, 210; 269/97

[56] References Cited

U.S. PATENT DOCUMENTS

| | | | |
|---|---|---|---|
| 601,523 | 3/1898 | Orchard | 248/229.15 |
| 614,880 | 11/1898 | Miller | 248/229.12 |
| 2,778,556 | 1/1957 | Johnson | 182/206 |
| 3,146,982 | 9/1964 | Budnick | 248/229.15 |
| 3,268,196 | 8/1966 | Anton | 182/129 |
| 3,887,034 | 6/1975 | Sawatky . | |
| 3,999,252 | 12/1976 | Bianco | 248/229.15 |
| 4,029,280 | 6/1977 | Golz . | |
| 4,184,666 | 1/1980 | Boitz . | |
| 4,294,444 | 10/1981 | Horton . | |
| 4,386,767 | 6/1983 | Dyckes | 182/129 |
| 4,641,822 | 2/1987 | Henerty . | |
| 4,995,578 | 2/1991 | Monheim . | |
| 5,092,427 | 3/1992 | Macmillan . | |
| 5,383,636 | 1/1995 | Karl | 248/229.15 |

FOREIGN PATENT DOCUMENTS

| | | | |
|---|---|---|---|
| 642101 | 6/1962 | Canada . | |
| 1292592 | 3/1962 | France | 182/206 |
| 2177443 | 1/1987 | United Kingdom . | |
| 2254876 | 10/1992 | United Kingdom . | |

*Primary Examiner*—Alvin Chin-Shue
*Attorney, Agent, or Firm*—Richard C. Litman

[57] ABSTRACT

A ladder vise assembly which is adapted for attachment to a step or ladder rung for immovably holding pipes and other suitable work materials. The assembly includes a stationary first clamp attached to one leg of a rung of a ladder with a vice module integrally built on it. A second clamp is adjustably spaced along a horizontal bar away from the first clamp. Both clamps include rotatable knobs for opening to receive a pipe and closing to hold the pipe firm in position. The vice module is slidably connected to a horizontal bar which connects the two clamps. An adjustable pipe-holder attachment is adapted to be affixed either to a wide bottom or narrow upper portion to of virtually any step ladder. A hole for locking the vise to a ladder is disposed within a bottom portion of the adjustable clamp to prevent removal.

9 Claims, 2 Drawing Sheets

LADDER VISE

CROSS-REFERENCE TO RELATED APPLICATION

This application claims the benefit of U.S. Provisional patent application Ser. No. 60/082,296, filed Apr. 20, 1998.

BACKGROUND OF THE INVENTION

1. Field of the Invention

The present invention relates generally to ladder attachments. More specifically, the invention is a ladder vise holder assembly for attachment to a step ladder for immovably holding pipes and other suitable work materials.

2. Description of Related Art

It has cost many craftsmen countless man hours to complete tasks while working on ladders over the years, due to the compromising position a ladder places a typical worker in. The actual work domain is usually determined by the circular space defined by the length of a worker's arm and 180° thereabout on both left and right sides of the worker, totalling a working domain of approximately 360°. While artificial devices or tools with extensions virtually extends this work space or work domain, the use of such devices becomes quite difficult for the craftsman where certain repairs are required to be performed in narrow areas within the work domain while on the ladder.

A device which allows multiple tasks and degrees of operable freedom by a skilled craftsman while positioned on the rungs of a ladder as herein described is lacking. For example, U.S. Pat. No. 3,887,034 issued to Sawatzky discloses a portable pipe clamp that can be hooked onto the rear rungs of a step ladder via a hook and loop mechanical connection. The single clamp provides the means by which a pipe is secured for an intended use. However the device can be quite cumbersome to a user on a ladder. Once the clamp has been fastened it is incapable of being rotated or translated away from the user as herein described.

U.S. Pat. No. 4,029,280 issued to Golz discloses a step ladder attachment comprising a U-shaped structure which secures a pair of wooden screen or storm sash attachments thereto along a rung of a step ladder. The device according to Golz is for specific applications related to window installations which is completely different from the instant invention as herein described.

U.S. Pat. No. 4,184,666 issued to Boitz discloses a flexible pipe vice for use with a ladder. A v-shaped chain linked pipe rest provides a foot controlled loop as a retainer for securing a pipe within the pipe rest for subsequent manipulation by a user. In order to effectively used the device, the user has to be partially positioned or standing having one foot on a lower ladder rung with the other foot positioned way from the ladder planted on the ground or a level surface.

U.S. Pat. No. 4,995,578 issued to Monheim discloses an apparatus and method for securing a tubular work-piece in position on a support. V-notched plates are mechanically fixed on left and right sides of a ladder between ladder rungs via nut and bolt bracket fasteners. The V-notches in the respective plates serve to retain a pipe or similar work-piece parallel to a rung.

Adjusting the device for placement between higher rungs on the ladder, while the user is on the ladder becomes quite difficult to accomplish, since each nut and bolt fastener would have to be completely removed by the user. As one might expect this can be time consuming and quite cumbersome for a user. A similar but simpler ladder attachment or bracket apparatus is disclosed by the Foreign Patent (GB 2 177 443) issued to Mighall from the United Kingdom. It is unclear how the apparatus functions as an effective vise as herein described by the instant invention.

U.S. Pat. No. 4,294,444 issued to Horton discloses a pipe gripping vise which mounts as a vertical structure to a flat bead of a motor-vehicle. The device according to Horton appears to be applicable for only large pipe structures and inadequate for ladders as herein described. Other U.S. and Foreign Patents by Fenetry (U.S. Pat. No. 4,641,822), MacMillan (U.S. Pat. No. 5,092,427), Ruggieri (CA 642,101) and Dallenger (GB 2 254 876) teach vises generally relevant to the instant invention, and have been cited as a matter of record.

The ladder vise of the instant invention is different from the prior and related art, in that it provides a multiple vise device which is sturdy and easily manipulable by a craftsman, electrician or journeyman while using a ladder to make repairs or installations of work materials thereon, in a relatively confined work space. In this regard, none of the above inventions and patents, taken either singly or in combination, is seen to describe the instant invention as claimed.

SUMMARY OF THE INVENTION

The ladder vise according to the invention is a clamp or vise pipe holder assembly which is adapted for attachment to a step or ladder rung for immovably holding pipes and other suitable work materials. The assembly includes a stationary first clamp attached to one leg of a rung of the ladder with a vise module integrally built on it. A second clamp is adjustably spaced along a horizontal bar away from the first clamp. Both clamps include rotatable knobs for securing the clamps to the ladder and opening to receive a pipe and closing to hold the pipe firm in position, respectively. The vise module is slidably connected to a horizontal bar which connects the two clamps. When in operation, the sliding vise may be pivoted away from the rungs of the ladder and out of the way of a ladder user. An adjustable pipe-holder attachment is adapted to be affixed either to a wide bottom or narrow upper portion of virtually any step ladder. A hole for locking the vise to the ladder is disposed within a bottom portion of the adjustable clamp to prevent removal.

Accordingly, it is a principal object of the invention to provide a ladder vise for holding multiple items on a ladder.

It is another object of the invention to provide a ladder vise which is durable and light-weight.

It is a further object of the invention to provide a ladder vise which is easily manipulable by a user while on a ladder.

Still another object of the invention is to provide a ladder vise which is adjustable for use with different ladders.

It is still another object of the invention to provide a ladder vise which can be locked and secured to a ladder.

It is an object of the invention to provide improved elements and arrangements thereof in the ladder vise for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention is directed to a ladder vise for attachment to a ladder at multiple rungs for use by a journeyman (i.e. craftsman, electrician, plumber, steam fitter, etc.) or handyman around the house. The preferred embodiments of the present invention are depicted in FIGS. 1 and 2, and are generally referenced by numeral 3.

Figure 1:
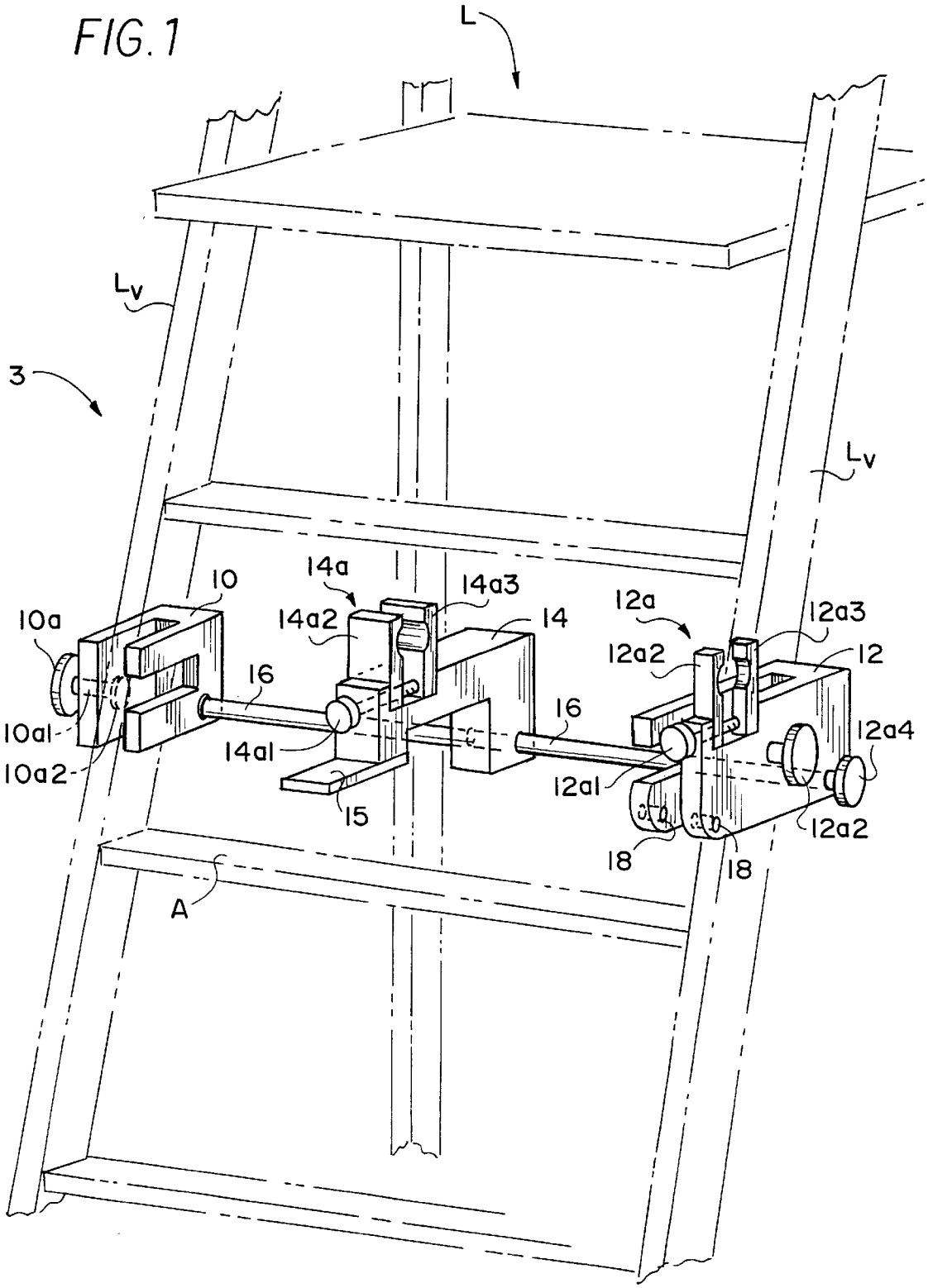
FIG. 1 is an environmental, perspective view of a ladder vise according to the present invention.

As best seen in FIG. 1, the ladder vise 3 comprises substantially U-shaped first and second clamps 10 and 12, respectively, for securing the vise 3 to a ladder L. A central vise module 14 is disposed between the clamps 10 and 12 via a connecting rod 16 which aligns the module 14 with the clamps 10,12 for proper use. The single connecting rod 16 allows both rotation R and translation T about and along the circular and linear dimensions of the rod 16. This dynamic motion of the central vise module 14 is better illustrated in FIG. 2.

Figure 2:
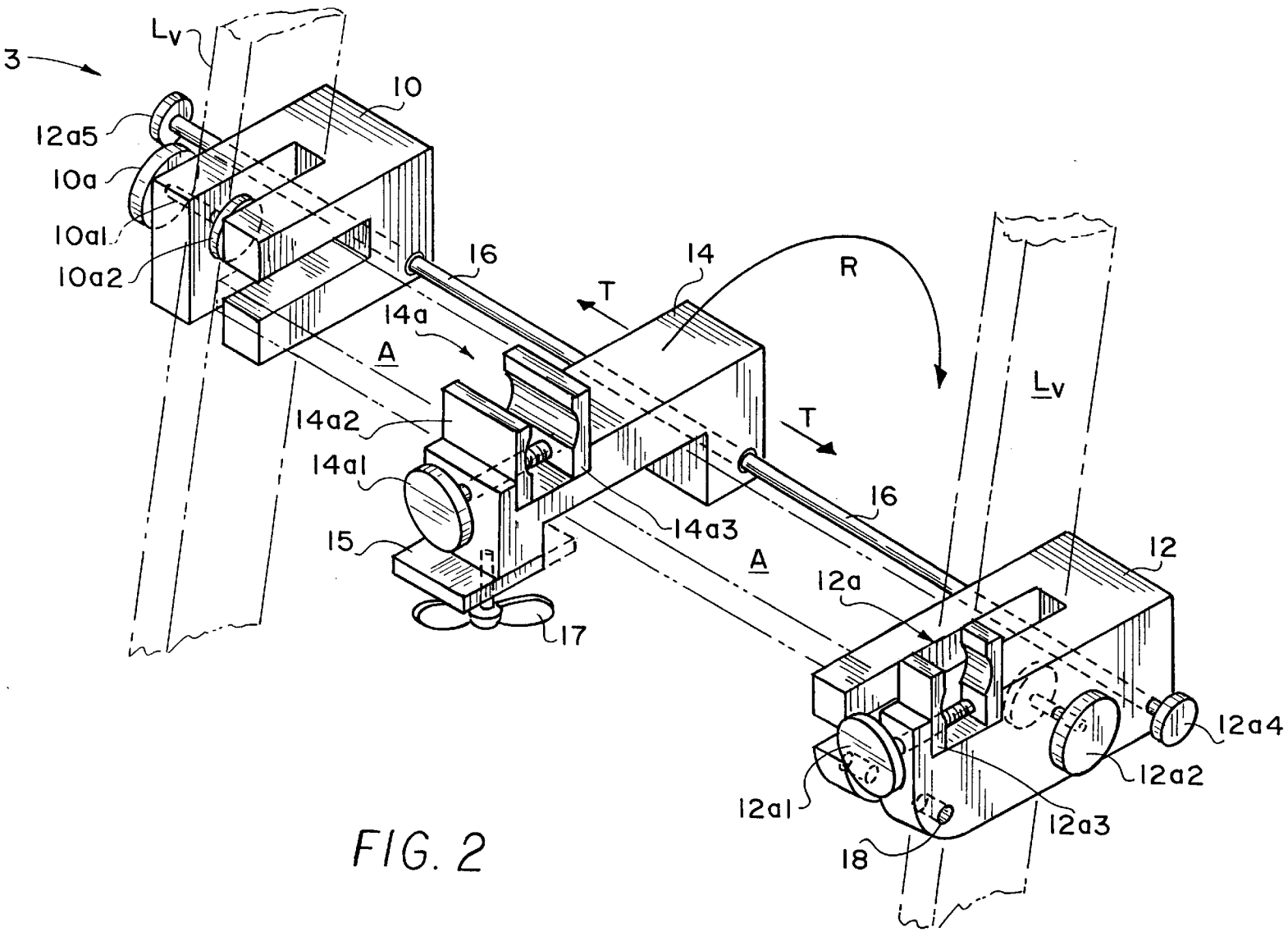
FIG. 2 is a perspective view of the ladder vise according to the invention, illustrating the dynamic features of the middle vice element.

In FIG. 2, the substantially C-shaped vise module 14 is shown in perspective view having multiple degrees of freedom while the device 3 is positioned on a rung A of a ladder L. The degrees of freedom include that of rotation R and translation T along and perpendicular to the rod 16 via a sub-component vise module 14*a* respectively. The module 14*a* further comprises a cylindrically shaped control knob 14*a*1 as an exemplary embodiment for opening and closing first and second substantially rectangular vise module members 14*a*2 and 14*a*3, respectively.

A clockwise rotation of the control knob 14*a*1 causes the member 14*a*2 to translate or close in a linear direction away from the knob 14*a*1 and toward the rod 16. To open the sub-component vise 14*a*, a counter-clockwise rotation of the knob 14*a*1 produces the intended result, moving the member 14*a*2 in just the opposite direction as recited above. Member 14*a*3 is a static or fixed member which serves to secure work materials therebetween when the vise member 14*a*2 is rotated to a closed position. An extension plate 15 is attached to a surface opposite that of and including the connecting rod 16 and the sub-component vise 14*a*.

A finger or butterfly screw 17 controls the adjustment of the extension plate 15 to the vise module 14*a* as diagrammatically illustrated in FIG. 2. As in some ladders the differences between rungs is of special interest to the skilled worker. For example, fiber glass ladders and wooden ladders vary in size, and thus distances between ladder rungs will vary. The extension plate 15 is used to correct for such differences and to provide a means by which the skilled worker could rest the module on a higher or lower rungs of a ladder to perform necessary work uninhibited. The substantially C-shaped structure of the vise module 14*a* allows the vise to be insertably attached to a rung A of the ladder L for effective use of the module 14*a*. The substantially U-shaped configuration of clamps 10 and 12 serve a similar function of allowing the clamps 10,12 to be a structural means by which to insertably attach the clamps to a particular rung A, at least, of a ladder L.

As recited above, the clamps 10 and 12 according to the instant invention are preferably substantially U-shaped first and second clamps 10,12 for insertably attaching to various rungs of a ladder L. The first clamp 10 is inserted and affixed to the vertical support structure $L_v$ of the ladder L diagrammatically illustrated in FIGS. 1 and 2. At least one control knob 10*a* is disposed within a side portion of the substantially U-shaped clamp 10 having a threaded stem 10*a*1 with a circular disk 10*a*2 at the end of the stem 10*a*1 for securing clamp 10 via the method of wedging to a vertical support structure $L_v$ of a ladder L. As an optional feature, the clamp 10 can also include a removable rectangular section at a bottom surface of the clamp 10. The surface of particular importance is closest to the central vise module 14 as shown in FIG. 2, below the rung A of the ladder L. (not shown) When the device is removed from the rung the removable rectangular section would provide a recess in the clamp 10 for attachment above the ladder rung A. The rectangular section can be affixed by mechanical fasteners such as finger or butterfly screws at least.

The second clamp 12 according to the instant invention further comprises a sub-component vise 12*a*, and at least three control knobs (12*a*1, 12*a*2, 12*a*4) for adjusting and securing the second clamp 12 and any work materials respectively to a ladder L. Control knob 12*a*1 mechanically activates the opening and closing of the vise 12*a* via a moveable vise member 12*a*2 and an unmovable vise member 12*a*3, as similarly taught for the sub-component vise 14*a* of the central vise module 14. Since both vises 12*a* and 14*a* are aligned via the connecting rod 16 both vises can be used simultaneously to secure pipe or similar work materials (i.e. flex cables such as Bx armor cable, Greenfield, liquid Tight, etc.) This particular arrangement helps to reduce labor cost, since it is a fast and convenient way to secure and cut various work materials for special tasks in a particular work domain.

Control knob 12*a*2 provides a means for securing the clamp 12 to a vertical structural element $L_v$ as similarly taught for the first clamp 10 above. The control knob 12*a*2 like control knob 10*a* has a threaded stem $\mathbf{12}a\mathbf{2}_a$ and a circular disk $\mathbf{12}a\mathbf{2}_b$ attached at the end of the stem $\mathbf{12}a\mathbf{2}_a$ for securing the clamp 12 to the ladder L by the mechanical method of wedging. Control knob 12*a*4 changes the length of the connecting rod to accommodate ladders having different widths. The other end 12*a*5 of the connecting rod 16 is fixed, thereby operating preferably by the mechanical screwing method for adjusting the ladder vise according to the instant invention to different lengths. Clockwise rotations of the control knob 12*a*4 shortens the length of the rod 16, and counter-clockwise rotations extends the length of the rod 16. Holes 18 disposed within the clamp 12 at a bottom portion of the clamp 12 near and below control knob 12*a*1 for accommodating a locking means such as a pad lock, etc. for preventing removal of the device for long term use at a specific location. While specific dimensions have not been particular disclosed for the type and size of various working materials, including the vise size corresponding to these dimensions, it would be obvious to one of ordinary skill in the art to provide the ladder vise according to the invention with specific dimensions related to the field of the craftsman as a matter of intended use.

Other practical advantages of the ladder vise according to the instant invention include the location and position of the rod relative to the ladder rungs. As a safety feature the connecting rod 16 has been designed to be behind and below the step or rung of a ladder to prevent accidents at higher rungs of the ladder. The craftsman has only to concentrate on the task at hand and not whether the ladder vise would be blocking movement at higher rungs of the ladder. Optional features include the use of chain clamps which can be adapted to the vise clamp module at least. Chain clamps have the advantage of providing a wider window or range of adjustability to accommodate different sized pipes or similar work materials.

It is to be understood that the present invention is not limited to the sole embodiment described above, but encompasses any and all embodiments within the scope of the following claims.

I claim:

1. A ladder vise for holding a workpiece adjacent to a ladder having at least one rung and at least two generally vertical supporting sides, said ladder vise comprising:

a first support clamp adapted for attachment to one of the at least two vertical supporting sides of the ladder;

a second support clamp adapted for attachment to another one of the at least two vertical supporting sides of the ladder;

a connecting rod disposed between said first support clamp and said second support clamp;

a vise module slidably mounted on said connecting rod between said first support clamp and said second support clamp;

a first vise element disposed on said vise module including first and second vise members;

a second vise element disposed on said second support clamp including a first and second vise members; and means for moving each first vise members relative to each respective second vise members;

wherein said second vise member of said first vise element being fixed to said vise module and said second vise member of said second vise element being fixed to said second support clamp.

2. The ladder vise according to claim 1, further comprising first means for frictionally engaging said first support clamp to the one of the at least two vertical supporting sides of the ladder; and second means for frictionally engaging said second support clamp to the another one of the at least two vertical supporting sides of the ladder.

3. The ladder vise according to claim 2, wherein said first support clamp being substantially U-shaped, said U-shaped clamp embracing the vertical side, said U-shaped clamp further including a notch for inserting the at least one rung of the ladder therein; and said second support clamp being substantially U-shaped, said U-shaped clamp embracing the vertical side, said U-shaped clamp further including a notch for inserting the at least one rung of the ladder therein.

4. The ladder vise according to claim 3, wherein said vise module being rotatable about said connecting rod, and said vise module having C-shaped portion for inserting the at least one rung of the ladder therein.

5. The ladder vise according to claim 4, said vise module further including means for releasably securing said vise module to the at least one rung of the ladder.

6. The ladder vise according to claim 1, said second support clamp further including means for locking said second support clamp to the another one of the at least two generally vertical support sides of the ladder.

7. The ladder vise according to claim 1, further comprising means for varying a length of said connecting rod;

wherein said connecting rod is adapted to be disposed behind and below the at least one rung of the ladder.

8. The ladder vise according to claim 1, wherein said vise module being linearly and rotationally translatable on said connecting rod.

9. The ladder vise according to claim 1, wherein said first vise element and said second vise element being aligned for holding a workpiece.

* * * * *